United States Patent [19]

Wasemann

[11] 4,125,003

[45] Nov. 14, 1978

[54] SUMP STRAINER FOR TUMBLER WASHING MACHINE

[75] Inventor: William A. Wasemann, Mansfield, Ohio

[73] Assignee: White-Westinghouse Corporation, Pittsburgh, Pa.

[21] Appl. No.: 721,707

[22] Filed: Sep. 9, 1976

[51] Int. Cl.[2] ..... D06F 39/08

[52] U.S. Cl. ..... 68/208; 210/460

[58] Field of Search ..... 68/18 F, 208; 134/72, 134/82, 104; 210/138, 143, 144, 167, 232, 416, 460, 162, 172, DIG. 8

[56] References Cited

U.S. PATENT DOCUMENTS

| | | | |
|---|---|---|---|
| 2,343,743 | 3/1944 | Breckenridge | 68/18 F |
| 2,360,278 | 10/1944 | Robertson | 210/416 R |
| 2,887,229 | 5/1959 | Schleicher et al. | 210/460 X |
| 3,121,473 | 2/1964 | Blystone | 210/172 X |
| 3,270,529 | 9/1966 | Engel | 68/18 |
| 3,407,633 | 10/1968 | Giambertoni | 68/18 F |
| 3,477,361 | 11/1969 | Bradshaw | 210/DIG. 8 |
| 3,959,137 | 5/1976 | Kirsgalvis | 210/232 |

*Primary Examiner*—Theodore A. Granger

*Attorney, Agent, or Firm*—McNenny, Pearne, Gordon, Gail, Dickinson & Schiller

[57] ABSTRACT

A tumbler type washing machine has a non-rotatable tub with a recessed sump at the bottom which is connected to drain. A perforate box-like strainer member is secured within the sump around the drain opening to prevent foreign objects in the tub from entering the drain hose and possibly damaging the pump. The strainer has a bottom member and a cover member and has projection which space the strainer from the walls of the sump.

4 Claims, 6 Drawing Figures

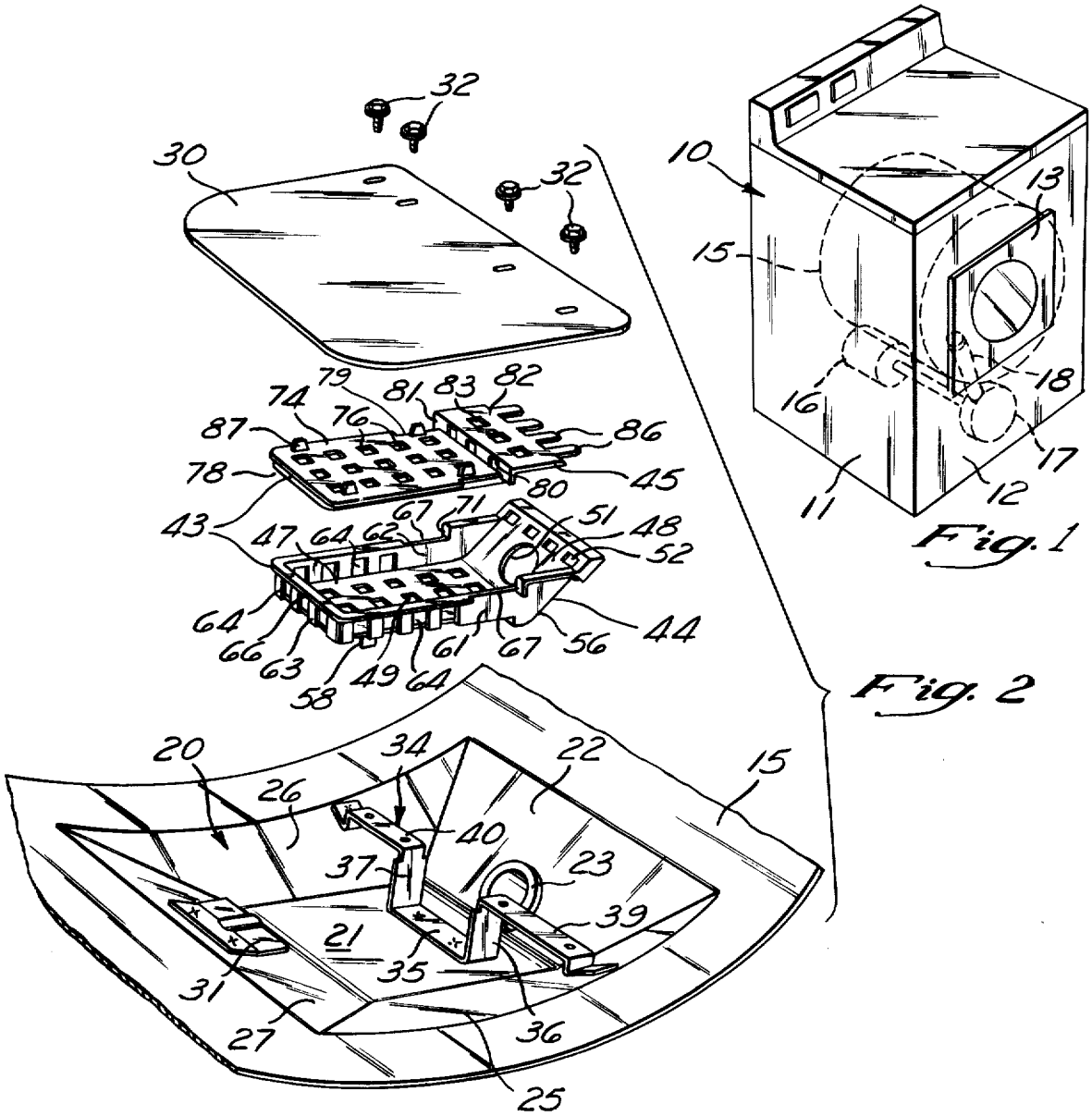
Fig. 1
Fig. 2
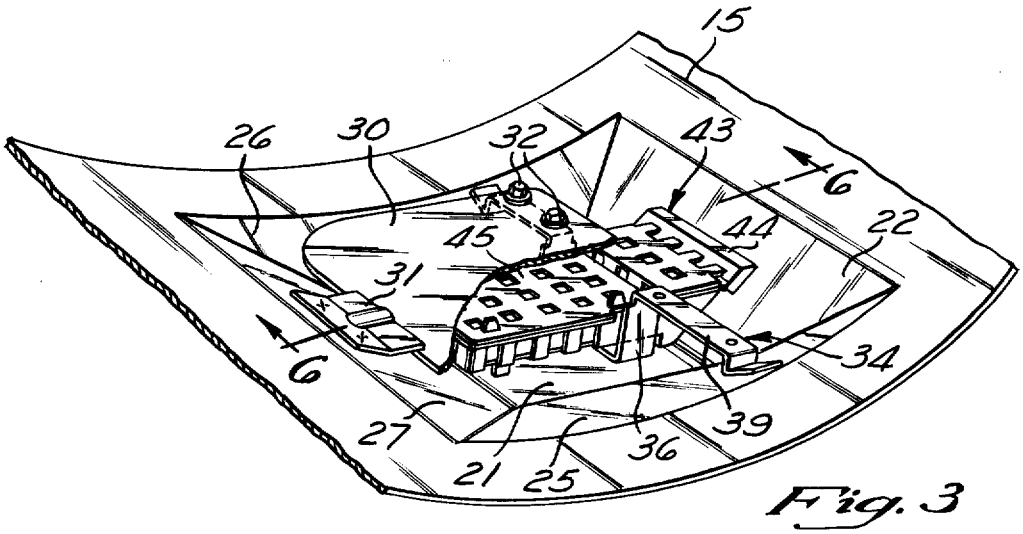
Fig. 3

SUMP STRAINER FOR TUMBLER WASHING MACHINE

BACKGROUND OF THE INVENTION

The invention relates to a strainer in the sump portion of the outer tub of a tumbler washing machine. In particular the invention relates to an improved strainer which forms a total enclosure around the entrance to the sump hose.

In a tumbler type washing machine the washing liquid drains out of the rotatable inner tub and is collected in the sump portion of the non-rotatable outer tub before it passes through the sump hose which is connected to the pump. The pump then pumps the water out of the machine in the drain cycle as controlled by operation of the timer.

It is very important that small solid foreign objects, such as buttons and coins which may be contained in the washing liquid be prevented from entering the hose leading to the pump in order to avoid clogging or damaging the pump. Prior art sump strainers have generally been perforated sheet member fitted against the walls of the sump around the drain opening leading to the pump.

The problem encountered with prior art sump strainers is that some small flat foreign objects such as dimes or buttons slide under the strainer and pass into the conduit leading to the pump. This problem results from the fact that the strainer must be large enough to accommodate a sufficient number of perforations so that the flow of washing liquid is not impeded. Of necessity the strainer must cover a substantial portion of the sump and be spaced away from the outlet so that the water flow will not be impeded if a portion of the strainer becomes covered with foreign material such as lint or paper. If the water flow during a drain cycle is excessively restricted, the timer may advance to another portion of the cycle before the tub is completely drained and thereby produce improper washing operation. Also, the strainer must be easily accessible and removable through restricted openings in the rotatable inner tub in order that it can be periodically inspected and cleaned.

SUMMARY OF THE INVENTION

This invention overcomes many of the prior art problems by providing a sump strainer which forms a perforate enclosure around the sump outlet leading to the pump. The strainer has the general form of a rectangular basket having relatively large flat top and bottom surfaces and relatively narrow side surfaces which are notched to fit within a bracket member having upstanding legs and which is attached to the bottom of the sump wall. One end wall of the basket is shaped to make a substantial sealing fit with a grommet portion of a drain hose secured in the sump while the opposite end wall extends substantially perpendicular to the side surfaces and top and bottom surfaces. All of the surfaces are perforated with generally square openings with the relatively large top and bottom surfaces providing a large number of openings and the side surface and one end surface providing a lesser number of openings.

The basket is preferably made in two members with the top surface forming one member and the remaining surfaces forming a second member so that the entire basket can be made from a suitable plastic material by an injection molding process. The bottom surface has a plurality of generally downwardly projecting lugs which space the bottom surface a distance upward from the bottom surface of the sump to allow free circulation of water to the underside of the strainer. Likewise, the top surface has a plurality of upstanding lugs in the portion away from the one end wall adjacent the drain hose to space the upper surface away from an imperforate sump plate or cover which is also secured to the bracket positioning the sump strainer and serves to engage the lugs on the upper surface to force the strainer down so that the lugs on the lower surface contact the bottom of the sump and hold the entire strainer assembly in position. The lugs on the upper surface also allow free circulation of water so the perforations on this upper surface and this upper surface member has a portion adjacent the drain opening which is offset by substantially the thickness of the lugs and this offset portion carries a plurality of projections which fit within suitable openings in the bottom member to position the members in place as a completely enclosed perforate box within the sump of the outer tub.

BRIEF DESCRIPTION OF THE DRAWINGS

FIG. 1 is a schematic perspective view of a tumbler or tumble action washing machine:

FIG. 2 is an exploded perspective view of the sump portion of the outer tub of the tumbler washing machine as shown in FIG. 1 showing the sump strainer of the present invention;

FIG. 3 is a perspective view similar to FIG. 2 but showing the parts in the assembled position with certain portions broken away;

DETAILED DESCRIPTION OF THE INVENTION

Figure 4:
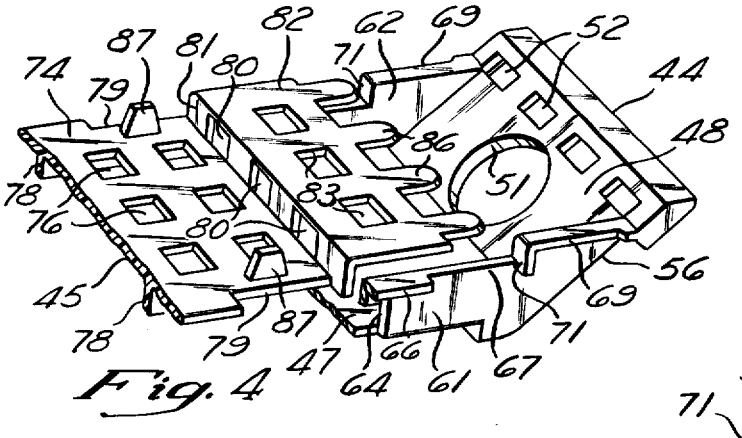
FIG. 4 is a partial perspective view of the sump strainer of FIGS. 2 and 3 with portions broken away showing the parts partially disassembled.
Figure 5:
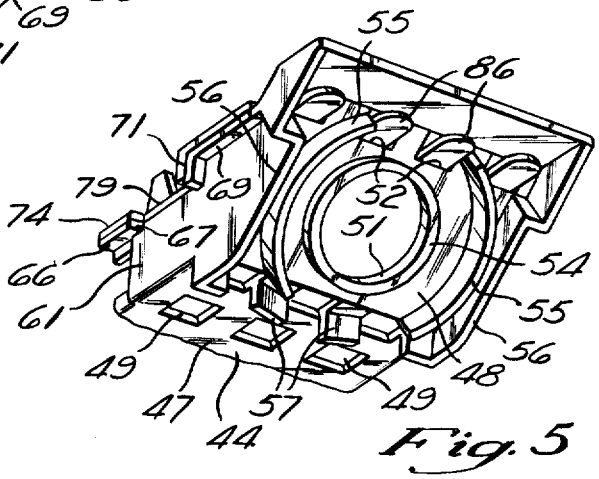
FIG. 5 is another perspective view of the sump strainer with the two parts in the assembled position with portions broken away.

Referring to the drawings in greater detail, FIG. 1 shows a tumbler or tumble action washing machine 10 of the front loading type. The washing machine has a generally box like cabinet 11 having a front face 12 in which is located a door 13 which opens to give access to the interior of the machine. Within the cabinet 11 is mounted a generally cylindrical outer tub 15 which is non-rotatable but mounted for resilient movement and which carries a rotatable inner tub (not shown) mounted for rotation about a horizontal axis. Attached to the outer tub 15 are a drive motor 16, and a drain pump 17 which is connected by a drain hose 18 to the outer tub 15 to pump the washing fluid therefrom through another suitable drain line (not shown).

Further details of the tumbler washing machine 10 are well known and will not be discussed in further detail. By way of example, details of such a machine are disclosed in patents to E. O. Morton, No. 2,994,216 granted August 1, 1961 and to Leslie A. Johnson and W. A. Wasemann, No. 3,262,661, granted July 26, 1966. These patents show the general arrangements of the drive mechanism and the resilient mounting of the outer tub which are not disclosed in further detail herein since they form no part of the present invention.

As shown in FIGS. 2 and 3, the outer tub 15 at its lowermost portion is provided with a downwardly recessed sump 20 formed by a relatively flat bottom wall 21 and a sloping sidewall 22 within which is mounted a grommet portion 23 of drain hose 18 adjacent the bottom wall 21. It should be appreciated that the sump 20 is not exactly centered at the bottom of the outer tub 15 but is offset slightly in the direction of rotation of the inner tub so that the portion at the junction of the bottom wall 21 and side wall 22 is the lowest part of the sump. The sump also includes sloping front and back walls 25 and 26 and an opposite side wall 27 all of which slope outwardly and upwardly from the bottom wall 21 to the surface of the outer tub 15.

Most of the sump 20 is covered by a sump cover 30 made of sheet material such as plastic or metal which extends over a major portion of the sump generally parallel with the bottom wall 21. The sump cover 30 is held in position on the one side by a projecting lug 31 secured to the side wall 27 and on its other side by screws 32 which engage a bracket member 34 which extends from front to back of the sump 20 between the front and back walls 25 and 26. The bracket member 34 has a center portion 35 which is secured to the bottom wall 21 by suitable means such as welding and from each side of which extend upwardly a pair of parallel legs 36 and 37 between the bottom wall 21 and the sump cover 30. A pair of cross pieces 39 and 40 extend outwardly from the legs 36 and 37 and are preferably secured at their outer ends to the front and back wall of 25 and 26 by suitable means such as welding.

The sump strainer assembly 43 is in the form of a box made up of two parts, a bottom member 44 and a cover member 45. The bottom member 44 includes a bottom wall portion 47 which is provided with a plurality of apertures 49 preferably arranged in a rectangular array of substantially uniform spacing. At the one side, a sloping wall 48 is connected to the bottom wall 47 and is provided with a circular drain opening 51 adapted to align with the drain hose 23 when the strainer is in position within the sump. Above the drain opening 51 are a plurality of apertures 52 in a linear array for purposes that will be explained in greater detail hereinafter.

Figure 6:
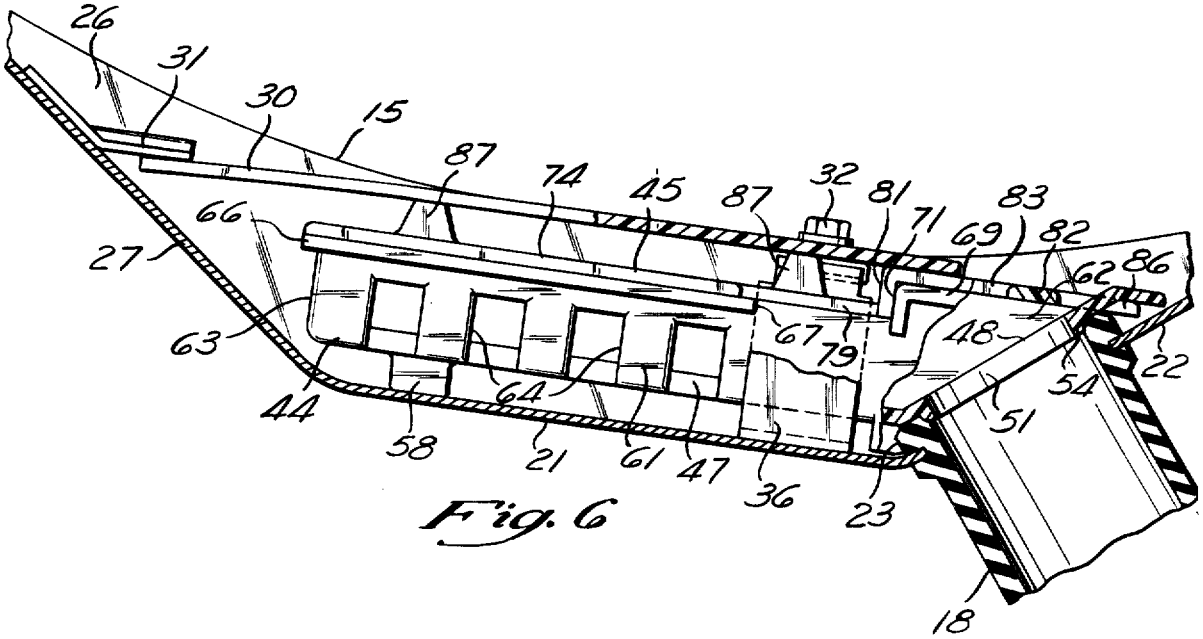
FIG. 6 is a cross sectional view taken on Line 6—6 of FIG. 3.

Around the drain opening 51, the sloping wall, on its outer side, is provided with an inner circular boss 54 adapted to fit within the opening of grommet portion 23 of the drain hose 18 as shown in greater detail in FIG. 6. At a spaced radial distance outwardly of the boss 54 are a pair of semicircular outer flange portions 55 which fit around the drain hose grommet 23 and which, with the inner boss 54, serve both to position the strainer with respect to the drain hose and make sufficient sealing engagement therewith to prevent the passage of foreign objects between the strainer and the drain hose. The sloping wall 48 is also provided with a pair of outwardly extending side flanges 56 which provide additional rigidity and seal against the wall of the sump. These flanges 56 extend downwardly below the bottom wall 47 which is also provided with a pair of legs 57 to provide a straining action at this point since the strainer is positioned a spaced distance above the sump bottom wall 21 by the side flange extensions 56, the legs 57 and another pair of legs 58 at the opposite end of the bottom wall 47. This arrangement allows free circulation of water underneath the sump so it can enter the sump strainer through the apertures 49 in the bottom wall as well as the other apertures to be described in greater detail hereinafter.

The bottom member 44 also includes front and back side walls 61 and 62, respectively, and an end wall 63 at the end opposite the sloping wall 48, all of which walls are joined together to make a box like arrangement and which in turn are provided with apertures 64 similar in size and shape to the apertures 49 in the bottom wall 47. The side walls 61, 62 and 63 at their upper edges are provided with an outwardly extending flange 66 at the upper edge thereof and the flange 66 is provided with notches 67 adjacent the sloping wall 48. It will be noted that the front and back side walls adjacent the sloping wall 48 have outwardly extending flanges 69 which are a slightly greater distance above the bottom wall 47 than the flange 66 and these flanges 69 terminate in vertical abutments 71 adjacent the notches 67.

The cover member 45 includes a main surface portion 74 which is provided with a plurality of apertures 76 in a regular array similar to the apertures 49 in the bottom wall 47 in the bottom member 44. The cover member 45 also includes a downwardly extending flange 78 projecting downwardly from the surface portion 74 and adapted to fit within the walls 61, 62 and 63 of the bottom member to position the cover member within the bottom member. The main surface portion 74 is of a size and shape to be coextensive with the flange 66 against which it abuts. The main surface portion 74 is also provided with a pair of notches 79 which are in general alignment with the notches 67 of the bottom member. At the end adjacent the drain hose, the cover member 45 has an upwardly offset wall 81 also having apertures 80 (see FIG. 4), which is adapted to engage the vertical abutment 71 on the bottom member and thereby secure these members in fixed relationship. An upper portion 82 extends from the vertical offset wall 81 toward the sloping wall 48 of the bottom member and this surface portion is also provided with a plurality of apertures 83 similar in size and shape to those previously described. At its free end, the upper surface portion 82 terminates in a plurality of projections 86 which are ranged to fit within the apertures 52 on the sloping wall 48 to prevent vertical movement of the cover member away from the bottom member. The main surface portion 74 is also provided with a plurality of upstanding legs 87 which have substantially the same vertical height as the offset wall 81 to position this surface below the sump cover 30 to provide free flow of fluid to the apertures 76.

As shown most clearly in FIGS. 2, 3 and 6 the sump strainer 43 with the cover member 45 assembled to the bottom member 44 is placed within the sump 20 and positioned therein by engagement of the notches 67 and 79 with the front and back legs 36 and 37 of the bracket member 34. With the sump cover in place and extending over the upper surface portion 82 of the cover member, the various projecting legs hold the strainer away from both the bottom wall and the sump cover to permit free circulation of the washing fluid through the various apertures therein. Since the bracket legs 36 and 37 position the strainer against any movement, the sump strainer is held in a position with the sloping wall 48 against the drain hose 23 and boss 54 and outer flange portions 55 provide further positioning restraint.

With this arrangement the sump strainer provides a complete enclosure which is sealed with respect to the drain hose 23 except for the various apertures in the two members. These apertures are arranged so that they can pass only the fluid and any objects small enough not to damage the pump, the strainer member will positively exclude from the pump hose any objects big enough to damage the pump. Since the sump strainer is freely positioned above the sump bottom wall 21 and below the sump cover 30, all sides are exposed to the fluid and there is adequate space within the sump around the sump strainer 43 to permit the accumulation of foreign objects such as coins or buttons without interfering with the draining of the washing fluid from within the machine and these objects can then be removed, and the sump cleaned, merely by removing the screws 32, releasing the sump cover 30 and removing the strainer 43. Normally, there would be nothing within the sump strainer 43, but if access to the interior is necessary, it is only necessary to lift the cover member 45 upwardly and slide it away from the sloping wall 48 so that the projections 86 are disengaged from the apertures 52.

Although the preferred embodiment of this invention has been shown and described, it should be understood that various modifications and rearrangements of the parts may be resorted to without departing from the scope of the invention as disclosed and claimed herein.

What is claimed is:

1. A laundry appliance having a non-rotatable tub, means defining a sump portion of the tub, a pump, a drain conduit having an inlet at the wall of said sump and connected to said pump, a strainer box to prevent articles from entering the pump through said drain conduit, and bracket means mounting said strainer box in said sump, wherein the improvement comprises said strainer box having an end with an aperture therethrough constructed and arranged to sealingly connect said drain conduit inlet to said strainer box, said box having perforated openings in its top wall, sidewalls and bottom wall, lug means constructed and arranged to space said sidewalls and bottom wall from corresponding walls of said sump into which said strainer box is located, said strainer box having notch means in cooperative engagement with said bracket means fixedly positioning said box in said sump and urging said box into sealing engagement with said drain conduit inlet.

2. The improvement according to claim 1 wherein said strainer comprises two separate members which are held together by said positioning means.

3. The improvement according to claim 2 wherein one strainer member has a bottom wall and a plurality of side walls, the other member has a top wall making a sealing fit with said side walls.

4. The improvement according to claim 3 wherein said bracket means includes a relatively flat sump cover above said strainer and said other member has projections extending upward in engagement with said sump cover to space said top wall downward from said sump cover.

* * * * *